United States Patent [19]

Case

[11] 4,356,075

[45] Oct. 26, 1982

[54] RIGID DANGLER ASSEMBLY FOR ELECTROPLATING BARRELS

[75] Inventor: George A. Case, Lexington, Ky.

[73] Assignee: Case Engineering Consulting Company, Lexington, Ky.

[21] Appl. No.: 278,165

[22] Filed: Jun. 29, 1981

[51] Int. Cl.[3] ..... C25D 17/20; C25D 17/10

[52] U.S. Cl. ..... 204/213; 204/280; 204/286

[58] Field of Search ..... 204/201, 212, 213, 279, 204/280, 286, 287

[56] References Cited

U.S. PATENT DOCUMENTS

| | | | |
|---|---|---|---|
| 889,744 | 6/1908 | Backus | 204/213 X |
| 1,509,534 | 9/1924 | Todd | 204/213 |
| 3,152,060 | 10/1964 | Belke | 204/213 |
| 3,330,753 | 7/1967 | Hepfer | 204/213 |
| 3,723,284 | 3/1973 | Ziebarth et al. | 204/213 |
| 4,105,526 | 8/1978 | Lewellen, Jr. et al. | 204/212 X |
| 4,305,804 | 12/1981 | Tipton | 204/279 X |

*Primary Examiner*—T. Tufariello
*Assistant Examiner*—N. Nguyen
*Attorney, Agent, or Firm*—Maurice L. Miller, Jr.

[57] ABSTRACT

Rigid dangler cathode assemblies for use in a conventional, rotatable electroplating barrel are disclosed which remain relatively stationary in position within the barrel as the barrel is rotated in an electrolyte solution in which it is immersed. Each of the assemblies includes an L-shaped rod having a vertically extending end portion which lies within a guideway of a hanger arm rotatably attached to the outer barrel end wall and a horizontally extending end portion which projects through a hub in the barrel end wall into the interior of the barrel. A disc-shaped weight is slippably mounted offcenter on the rod within the barrel, which weight has a center of gravity below the rod. A rigid, elongated metallic dangler arm is slippably connected on one end portion thereof to a lower portion of the weight below the center of gravity thereof so that the arm remains relatively stationary and does not flip out of the electrolyte as the barrel rotates, thus reducing or eliminating the burning of parts being plated within the rotating barrel which would otherwise occur due to electric arcing. The dangler may be generally S-shaped in construction and may also have crimped segments spaced along the length thereof to aid in separating parts being plated in the barrel which stick together along flat surfaces thereof due to surface tension. The crimped segments tend to separate such parts upon striking the latter as the barrel rotates in the solution.

10 Claims, 5 Drawing Figures

RIGID DANGLER ASSEMBLY FOR ELECTROPLATING BARRELS

BACKGROUND OF THE INVENTION

This invention relates generally to apparatus for electroplating articles. More specifically, it relates to cathodes, sometimes called danglers, and associated structure, which are disposed within an electroplating barrel and carry an electrical potential which, in conjunction with anodes energized with a potential of opposite polarity, cause metal ion migration through a liquid electrolyte in which the barrel is immersed, thus producing metal plating of articles contained in the barrel.

Generally speaking, such apparatus and cathodes have long been known and used in the prior art such as, for example, the structures disclosed in U.S. Pat. No. 784,034 issued to G. W. Clough on Mar. 7, 1905 and U.S. Pat. No. 889,744 issued to C. G. Backus on June 2, 1908. Inumerable articles of every kind and description are electroplated in such prior art apparatus including nails, fasteners, coins, and jewelry, to name but a very few. More recently, molded plastic electroplating barrels have been in wide use in this country which include plastic or plastic-coated metal hanger arms rotatably attached to opposite ends of the barrel which permit the barrel to be rotated while immersed in a liquid electrolyte. An insulated copper cable extends from terminals, called horns, located on an upper end portion of the hanger arms, downward along guideways in the arms and into the interior of the barrel through hubs in the barrel end walls in which the arms are rotatably connected. The free ends of the cables disposed within the barrel contain exposed metallic end portions to which metal ions migrate through electrolyte solution flowing through the barrel. Some of these metal ions are deposited on the surfaces of parts or articles contained in the barrel, thus producing the desired plating. An electric potential difference sufficient to produce the desired ion migration in the solution is applied between the anodes located in the solution, but outside of the barrel, and the horns on the hanger arms from a remote power source located beyond the tank containing the liquid electrolyte in which the barrel is immersed. The cathode terminals or danglers, derive their popular name from the fact that they are flexible cables which hang limply in the barrel from the end wall hubs through which they project.

One problem that is frequently encountered using such flexible dangler cables is that the free end portions thereof tend to flip about within the barrel as the barrel, containing large quantities of articles to be plated, is rotated in the electrolyte. From time to time during the plating process, these danglers will flip upward in the barrel such that their exposed metallic end portions actually project above and clear of the level of the electrolyte solution flowing through the barrel. As the end portions of the cables fall back into the solution, they occasionally strike a single one of the numerous articles being plated in the barrel, thus producing severe burning of the article ultimately requiring its rejection. Of perhaps thousands of individual articles being plated in the barrel during a given plating operation, hundreds of such articles may have to be rejected because of such burns or scorches caused by repeated flip-flopping of the danglers into and out of the solution. Not only does the rejection of such articles result in fewer acceptably plated articles per plating operation, but the time required to manually separate the individual burned articles from the acceptably plated artices is substantial.

My invention substantially overcomes this and other problems encountered using such prior art electroplating apparatus and danglers.

SUMMARY OF THE INVENTION

It is an object of my invention to provide a novel dangler assembly for an otherwise conventional electroplating system.

It is a further object of my invention to provide a set of rigid dangler elements which remain more or less stationary below the level of an electrolyte as an electroplating barrel in which the elements are disposed is rotated in the electrolyte during a plating operation.

It is yet another object of my invention to provide cathode elements for an electroplating system which produce metal plating of parts contained in an electroplating barrel with substantial fewer burns or scorches of such parts than has been obtainable using conventional electroplating apparatus known in the prior art.

Briefly, in accordance with the principles of my invention, a dangler assembly adapted for disposition within a hollow, rotatable electroplating barrel is provided. The assembly includes a rigid, elongated, electrically conductive cathode arm disposed within a lower portion of the barrel, and an electrically conductive counterbalancing means slippably connected to the arm. Also included is means slippably connecting said electrically conductive counterbalancing means to an end wall of the barrel. A second counterbalancing means is fixedly connected to the arm for balancing the arm in the electrically conductive counterbalancing means. Lastly, there is included a means for electrically connecting the arm to a source of d.c. electrical potential located remote with respect to the barrel.

These and other objects, features and advantages of my invention will become apparent to those skilled in the art from the following detailed description and attached drawings upon which, by way of example, only the preferred embodiments of my invention are illustrated.

DESCRIPTION OF THE PREFERRED EMBODIMENTS

Figure 1:
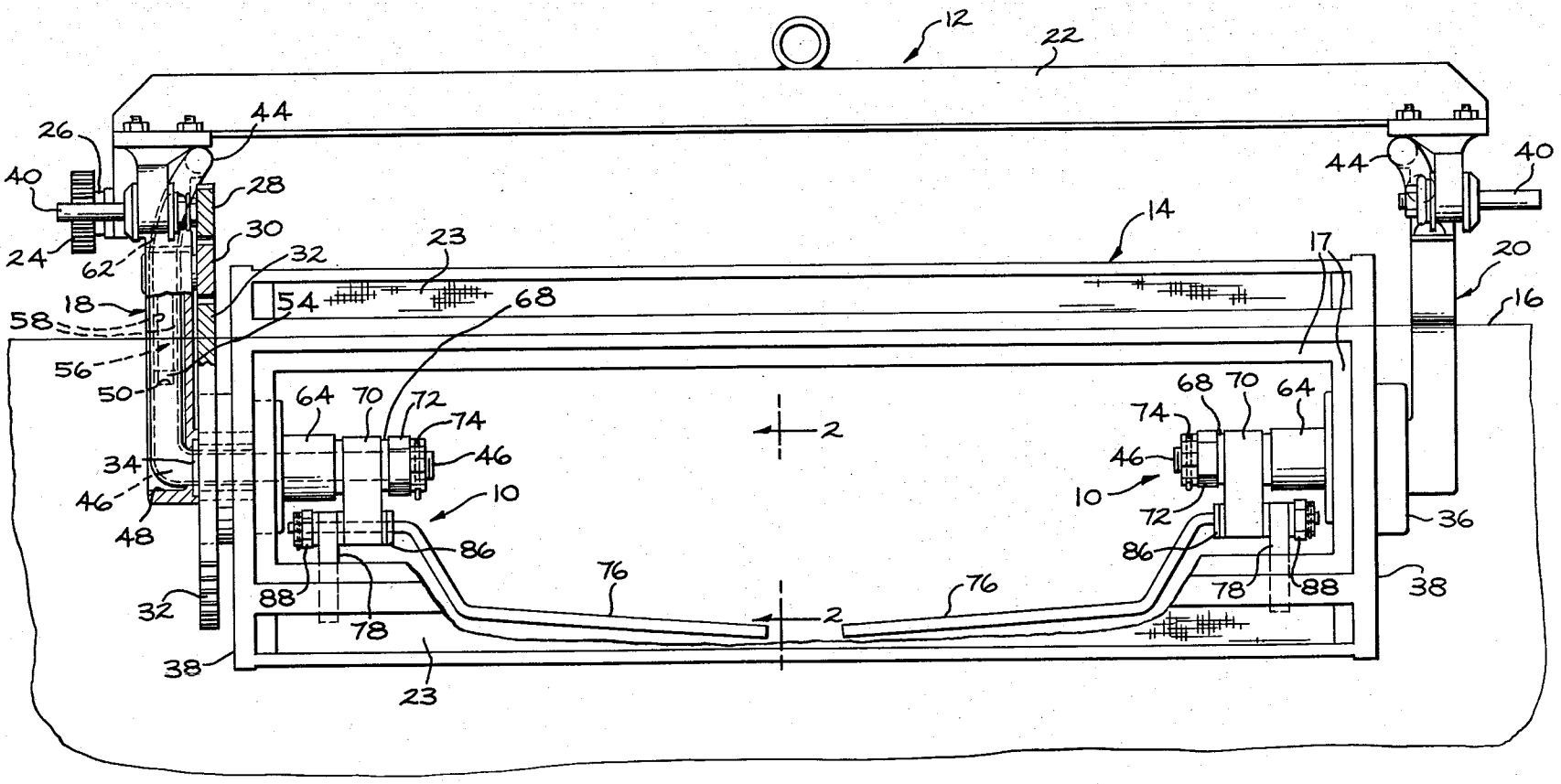
FIG. 1 shows a front elevation view of a pair of dangler assemblies disposed in an electroplating system, thus illustrating one preferred embodiment of my invention.
Figure 2:
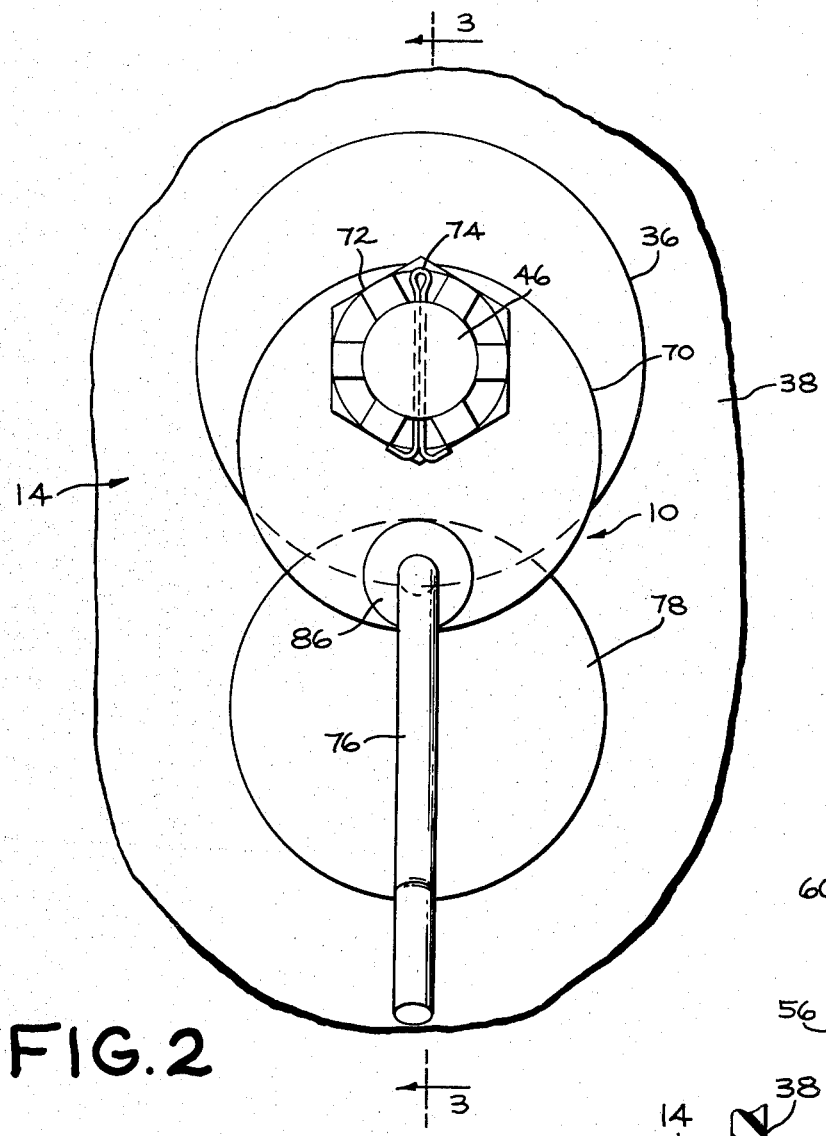
FIG. 2 shows a cross-sectional elevation view of one of the dangler assemblies of FIG. 1 as viewed along lines 2—2 of the latter figure.
Figure 3:
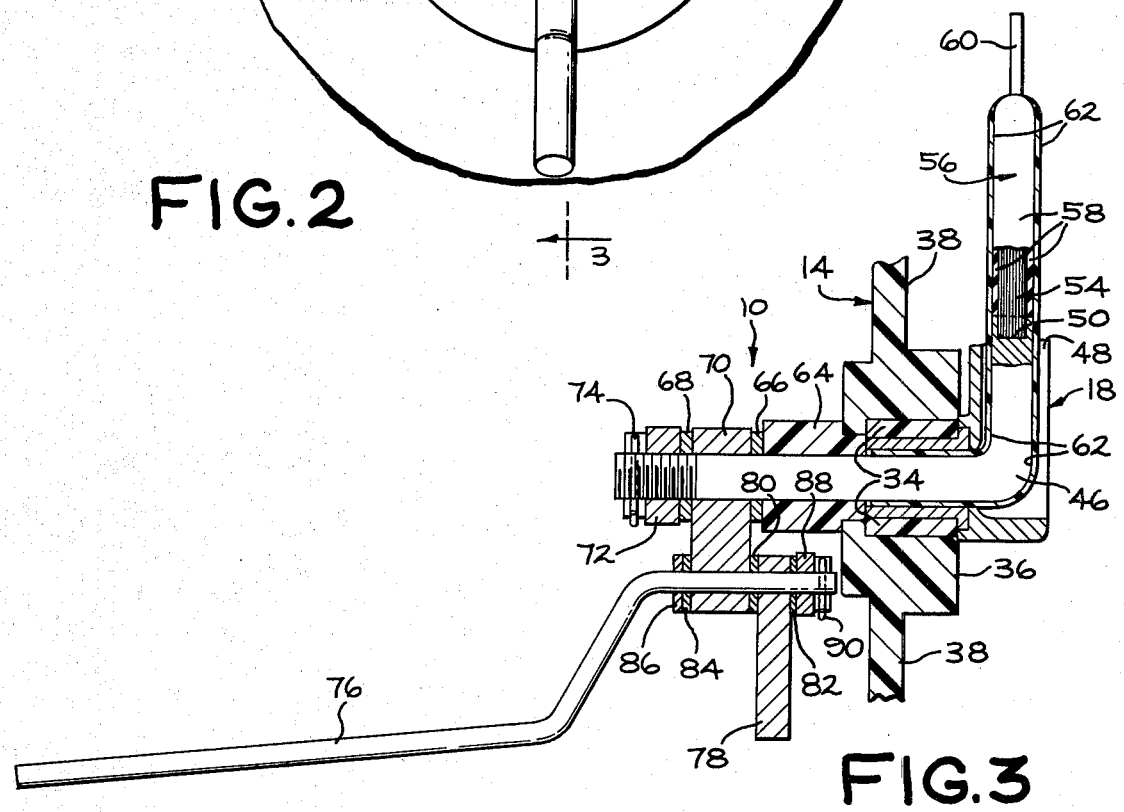
FIG. 3 shows a cross-sectional front elevation view of the dangler assembly of FIG. 2.
Figure 4:
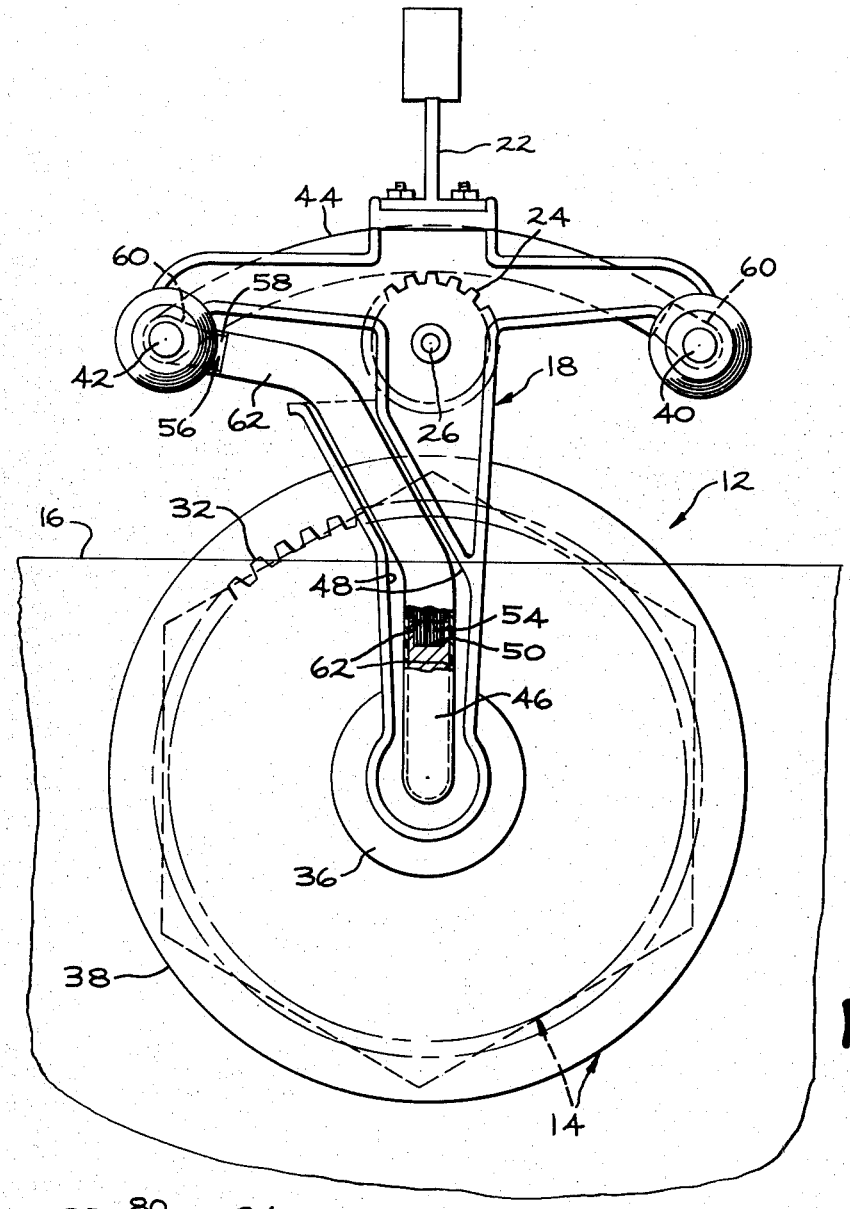
FIG. 4 shows an end elevation view of the system of FIG. 1 together with a portion of the dangler assembly of FIGS. 2–3.

Referring now to FIGS. 1–4 of the drawings, there is shown, in one preferred embodiment of my invention, a pair of dangler assemblies 10 as used in combination with an otherwise conventional and well known electroplating system 12.

The conventional features of the system 12 include a rotatable, hollow drum or barrel 14 adapted for partial submersion in an acid or alkali solution 16 which acts as an electrolyte when subjected to a d.c. potential in the usual, well known manner. A quantity of parts of various types and descriptions to be electroplated, not shown, may be loaded into the barrel 14 through a rectangular door opening defined by a lip 17 after which a door, not shown, is clamped in place against the lip 17 in a suitable manner to confine the parts within the barrel 14 as it rotates in the solution 16 during the plating operation. The barrel 14 is suspended at opposite ends thereof by means of a pair of conventional plastic or plastic-coated metal hanger arms 18, 20 which are, in turn, bolted to opposite end portions of an overhanging tee member 22. The electrolyte solution flows into the interior of the barrel 14 around the parts being electroplated therein and the assemblies 10 through grates 23. The arms 18, 20 serve the dual purpose of providing guide means by which the necessary negative d.c. potential is supplied from a suitable remote source, not shown, to the dangler assemblies 10, as later more fully explained, and of rotatably suspending the barrel 14 in the solution 16. A positive d.c. potential is applied to conventional anode elements, not shown, which are located in the solution 16 outside of the barrel 14, all in the usual, well known manner. The arms 18, 20 are similar in construction except that the arm 18 is provided with a drive gear 24 connected by means of a shaft 26 to a drive train 28, 30 which, in turn, drives a large gear 32 which is fixedly connected to one end of the barrel 14. A suitable drive motor, not shown, located outside of the vessel or tank containing the solution 16 is coupled to the gear 24 in the usual, well known manner to produce the desired barrel rotation during the plating operation. In some conventional electroplating systems, a belt drive may also be used to rotate the barrel 14 instead of the gear train as shown in the present example.

The arms 18, 20 contain rotatable dielectric collars 34, usually constructed of plastic, on lower end portions thereof, which collars fit snugly within conforming cylindrical openings in a pair of hubs 36 located on opposite barrel end walls 38. When ready for use, the assembly 12 may be lowered into a tank containing the plating solution 16 by means of a suitable hoist, not shown, which is connected to the tee member 22. Each of the arms 18, 20 contain a pair of elongated cylindrically shaped electrical terminals or horns 40, 42 which project outwardly away from the barrel end walls 38 and which are adapted to seat within aligned and conventional V-shaped electrical terminals or V-saddles, not shown, usually located on the top rim of the plating tank on opposite ends thereof as the barrel 14 is lowered into position in the solution 16. A suitable source of electrical potential is then supplied to the V-saddle terminals and thence to the horns 40, 42 in a well known manner. Typically, the horns 40, 42 on each of the arms 18, 20 are electrically connected together by means of an insulated electrical jumper cable 44. Where conventional cable dangler assemblies, not shown, are employed within the barrel 14, such cables are connected from one of the horns 40, 42 on each of the arms 18, 20 and brought down through the latter into the interior of the barrel 14 through the openings in the hubs 36, all in a well known manner. A more complete description of such conventional danglers and electroplating systems can be obtained from plating equipment manufacturers such as NAPCO, Napco Drive, Plymouth Industrial Park, Terryville, Conn. 06786. An excellent background on prior art electroplating techniques and equipment will also be found in Metal Finishing Guidebook Directory, 39th annual edition (1971), published by Metals and Plastics Publications, Inc., 99 Kimberkamack Road, Westwood, N.J. 07675.

Now, in accordance with the principles of my invention, the dangler assemblies 10 as used in combination with the otherwise conventional electroplating system 12 will now be explained. The dangler assemblies 10 of the present example are of identical construction, whereby only the assemblies 10 which connects to the geared hanger arm 18 is shown in FIGS. 1–4 in complete detail and will be explained. The explanation to follow is, however, equally applicable to both.

Accordingly, the subject assembly 10 includes a rigid, cylindrical rod 46 bent into L-shape form in any suitable and well known manner, and constructed of a suitable electrically conductive metal. A vertically extending portion of the rod 46 lies within a lower portion of the guideway 48 on the arm 18. A horizontally extending portion thereof projects from the lower end of the guideway 48, through the collar 34 and hub 36 and into the hollow interior of the barrel. A groove 50 bored into an upper end portion of the rod 46 contains the lower ends of strands 54 of an insulated electrical cable 56. An outer layer 58 of insulation is stripped back from the lower end of the cable 56 to permit the exposed strands 54 to be soldered in the groove 50 to obtain a suitably low resistance connection or joint. The upper end of the cable 56 connects to the horn 42 by means of a suitable terminal 60 soldered to the upper ends of the strands 54. A length of flexible heat shrink tube 62, impervious to the solution 16, is applied over and around the cable 56 from a top end portion thereof near the terminal 60 downwardly over the soldered joint, and thence downwardly along and around the rod 46 to a position well inside the collar 34. The tube 62 thus shields the otherwise bare portion of the rod 46 from direct exposure to the solution 16 so that the rod 46 will not become successively plated during successive electroplating operations in which the system 12 and assemblies 10 are employed.

The horizontally extending portion of the rod 46 projects through the collar 34 into the interior of the barrel 14 through a cylindrically shaped dielectric spacer 64, a pair of flat washers 66, 68 slippably mounted thereon, and a disc shaped counter-balance 70, constructed of electrically conductive metal, slippably mounted thereon between the washers 66, 68. A castle nut 70 is screwed onto a threaded end portion of the rod 46 and secured thereto by means of a cotter key 74. A shaft in the counter-balance 70 through which the rod 46 projects is located well offcenter thereof so that the center of gravity of the subject disc shaped element lies below the bottom level of the rod 46. A dangler element 76 constructed of a suitable electrically conductive material and bent in any suitable manner into a generally S-shaped form projects along an upper end portion thereof through a hollow shaft in a bottom portion of the counter-balance 70, thence through an upper portion of a second disc shaped counter-balance 78 threaded or key mounted thereon. A pair of flat washers 80, 82 are slippably mounted on the arm 76 on either side of the counter-balance 78. A pair of flat washers 84, 86 are mounted on the arm 76 on the other side of the counter-balance 70 from the washer 80. The washer 84 is slippable and flush against the counter-balance 70 while the washer 86 mounted flush against the washer 84 is welded to the arm 76. The arm 76 is held in place by means of a castle nut 88 screwed into a threaded end portion thereof and secured thereto by a cotter key 90.

The counter-balance 70, being slippably mounted on the rod 46, tends to maintain the dangler arm 76 in a lower portion of the barrel 14 and well below the level of the solution 16 at all times as the barrel 14 rotates during plating operations. Since the arm 76 does not flip or jump out of the solution 16 and fall back against parts being electroplated in the rotating barrel, burning and scorching of parts for that reason is virtually eliminated. The counter-balance 78 is used on the upper end of the arm 76 to counter-balance the weight of the remainder of the arm 76 which projects toward the bottom center of the barrel 14 so that an even electrical contact is made between the counter-balance 70 and the portion of the arm extending through the shaft in the latter along the entire length of the shaft. The lower ends of the pair of dangler arms 76 should lie near the bottom of the barrel 14, near the center thereof, and be separated from one another by approximately one or more inches.

To complete the description of the present example of my invention, I recommend that the cable 56 be of 4/0 gauge, 600 volt rating consisting of a core 54 of braided copper wire surrounded by rubber insulation, 1/16 inch in thickness. The terminal 60 should be of solid copper to assure resistance contact with the horn 42. I strip about one-inch of insulation back from the lower end of the core 54 and dip the exposed strands in a suitable flux prior to soldering the same within the groove 50 at the upper end of the rod 46. The rod 46 may have a diameter of one inch and the groove 50 may be ⅞ inch in diameter, thus leaving a 1/16 inch sidewall in the groove 50. The depth of the groove 50 may be about one inch. Prior to placing the exposed strands 54 in the groove 50, the surfaces of the latter may be copper-plated, tinned or both, then filled about half full of 60–40 solder. The strands 54 are then heated and, while the flux thereon is still in a molten state, inserted into the groove 50 and held in place until the solder therein has become molten and then solidified. Next, the soldered joint is crimped after which the heat shrink tube 62 is slipped down over the cable 56, welded joint between the strands 54 and the upper grooved end of the rod 56, and around the right angle bend in the latter. The tube 62 should extend far enough along the horizontal portion of the rod 56 to assure entry of the lower end of the tube 62 into the collar 34 such that its lower end terminals at or near the dielectric spacer 64 when the rod 46 is inserted into the guideway 48 and collar 34. After the rod 46 is inserted in place in the arm 18, the dielectric spacer 64 is slipped over the horizontal end of the rod 46 and pressed into the opening of the hub 36. The castle nuts 72 and 78 should be screwed onto the threaded end portions of the rod 46 and arm 76, respectively, so that both counter-balances 70 and 78 rotate freely but do not slide back and forth in a sloppy manner. The dangler arms 76, counter-balances 70 and 78, and rod 46 may be made of such materials as carbon steel, inconel metal alloy, monel metal, 300 and 400 series stainless steel, titanium, 1000–8000 series aluminum, copper, bronze, beryllium copper alloy, or lead coated copper, among others. The material actually selected will depend upon the type of plating process to be employed all as is well known to those skilled in the electroplating art.

Numerous types of plating processes can be employed using the dangler 10 including those for plating brass, bronze, cadmium, copper and copper alloys, iron, indium, lead and lead alloys, nickel and nickel alloys, silver, gold, tin and tin alloys, zinc, rhodium, platinum and palladium as well as possibly chromium and other metals.

Figure 5:
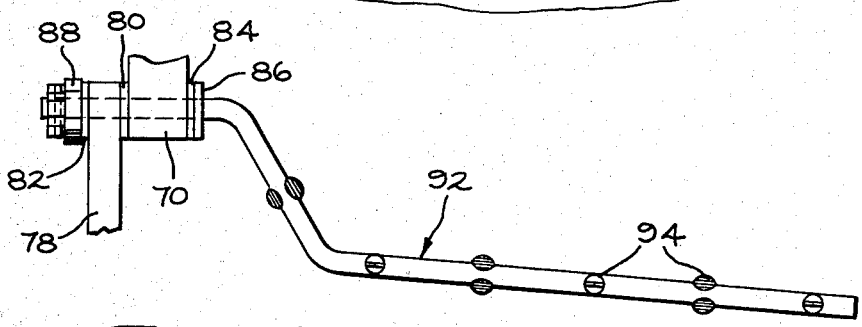
FIG. 5 shows a front elevation view of an alternative dangler assembly which may be used in the system of FIG. 1 in place of the dangler assembly shown therein, thus illustrating another preferred embodiment of my invention.

Referring now to FIG. 5, there is shown a dangler arm 92 which may be substituted in place of the arms 76 in the assembly 10 of the previous example, the difference being a series of crimped segments 94 formed at intervals of about one inch along a portion of the length of the arm 92 which extends diagonally downward from the counter-balance 70 and outwardly therefrom. The segments 94 may be formed in the usual well known manner with a conventional press and serve to separate, on contact, parts such as flat washers which may tend to stick together in the solution 16 during a plating operation because of surface tension between their adjoining flat surfaces. Previously such parts have had to be rejected from batches of plated parts because they do not become plated upon the surfaces that are stuck together. The arm 92 aids in minimizing such rejectable and partially unplated parts.

Although the present invention has been described with respect to specific details of certain preferred embodiments thereof, it is not intended that such details limit the scope of protection to be afforded hereby other than as set forth in the following claims.

I claim:

1. In an electroplating system of the type which includes a rotatable, hollow barrel adapted for submersion in a liquid electrolyte solution, and a pair of hanger arms connected by means of rotatable collars disposed within hubs located on opposite end walls of said barrel, a pair of dangler assemblies disposed in said barrel, each of which assemblies comprises:

a rigid L-shaped electrically conductive rod having a vertically extending end portion disposed in a guideway on one of said hanger arms and a horizontally extending end portion projecting through one of said hubs and collars into the interior of said barrel, first electrically conductive counter-balancing means slippably mounted on said rod and having a center of gravity below the level of said rod, a rigid, elongated electrically conductive dangler arm having one end portion slippably connected to said counter-balancing means below the center of gravity thereof and an opposite end portion projecting along a lower portion of said barrel toward a vertical centerline thereof, means for electrically connecting said rod to a remote source of d.c. potential, and means for protecting a portion of said rod and electrically connecting means from exposure to said solution to inhibit the plating of said rod portion and electrically connecting means during successive electroplating operations employing said system.

2. The electroplating system of claim 1, wherein each of said assemblies further comprise second counter-balancing means slippably connected to said one end portion of said dangler arm for minimizing the effect of the bending moment applied to said first counter-balancing means by said opposite end portion of said dangler arm for improving electrical contact between said first counter-balancing means and said dangler arm.

3. The electroplating system of claim 1 wherein each of said assemblies further comprise dielectric spacer means slippably mounted on said dangler arm between said first counter-balancing means and said hub.

4. The electroplating system of claim 1, wherein each of said dangler assemblies further comprises means for securing said first counter-balancing means on said rod.

5. The electroplating system of claim 1 wherein said dangler arm is generally S-shaped.

6. The electroplating system of claim 1 wherein each of said dangler assemblies further comprises means connected to said dangler arm for separating, on contact, parts being electroplated in said barrel which are stuck together in said solution due to surface tension.

7. The electroplating system of claim 1 wherein said first counter-balancing means is disc shaped.

8. The electroplating system of claim 1 wherein said rod, first counter-balancing means and dangler arm are constructed of the group of metals consisting of carbon steel, titanium, aluminum, copper, bronze, beryllium copper alloy, lead coated copper and 300 and 400 series stainless steel.

9. The electroplating system of claim 1 wherein said electrical connecting means comprises an electrical cable having an electrically conductive wire core soldered into a groove formed in an upper end portion of said rod, said cable extending from said groove along said guideway to a terminal on said hanger arm.

10. A dangler assembly adapted for disposition within a hollow, rotatable electroplating barrel comprising a rigid, elongated electrically conductive cathode arm disposed within a lower portion of said barrel, electrically conductive counterbalancing means slippably connected to said arm, means slippably connecting said electrically conductive counterbalancing means to an end wall of said barrel, second counterbalancing means fixedly connected to said arm for balancing said arm in said electrically conductive counterbalancing means, and means for electrically connecting said arm to a source of d.c. electrical potential located remote with respect to said barrel.

* * * * *